US006520193B2

(12) United States Patent
You

(10) Patent No.: US 6,520,193 B2
(45) Date of Patent: Feb. 18, 2003

(54) UMBRELLA WITH VENTS ON THE UMBRELLA CLOTH FOR VENTING WIND

(76) Inventor: Ching-Chuan You, c/o Percy International Patent Corp., P.O. Box 1-79, Taipei (TW)

( * ) Notice: Subject to any disclaimer, the term of this patent is extended or adjusted under 35 U.S.C. 154(b) by 0 days.

(21) Appl. No.: 09/816,449

(22) Filed: Mar. 26, 2001

(65) Prior Publication Data

US 2002/0134412 A1 Sep. 26, 2002

(51) Int. Cl.[7] ..... A45B 25/26
(52) U.S. Cl. ..... 135/33.7; 135/33.4
(58) Field of Search ..... 135/27, 33.2, 33.7, 135/33.4, 16; D3/5

(56) References Cited

U.S. PATENT DOCUMENTS 3,456,661 A * 7/1969 Farley ..... 135/33.7
5,482,069 A * 1/1996 Lee ..... 135/33.7
5,601,103 A * 2/1997 Dubinsky ..... 135/33.7
5,640,984 A * 6/1997 Dubunsky ..... 135/33.7
5,678,586 A * 10/1997 Baksh ..... 135/33.7
5,890,506 A * 4/1999 Kupferman ..... 135/33.7
6,006,769 A * 12/1999 Lin ..... 135/33.7
D453,415 S * 2/2000 You ..... D3/5
6,155,278 A * 12/2000 Lin ..... 135/33.7
6,170,499 B1 * 1/2001 Lin ..... 135/33.7
6,202,662 B1 * 3/2001 Lin ..... 135/33.7
6,250,319 B1 * 6/2001 You ..... 135/33.7

FOREIGN PATENT DOCUMENTS

DE 4115467 * 3/1991 ..... 135/33.7

* cited by examiner

*Primary Examiner*—Janet M. Wilkens

(57) ABSTRACT

An umbrella comprises an umbrella frame, a lower cloth, and an upper cloth, the upper cloth being in covering relation to an upper periphery of the lower cloth. The upper periphery in each sector of the lower cloth is formed as a suspending cambered-recess element. A plurality of cambered-recess elements are formed by a piece of elongate cloth. A continuous multiple-lobe element is formed along the upper periphery of the lower cloth by stitching the suspending cambered-recess elements to the upper periphery of the lower cloth. The upper periphery of each unit of the lower cloth is loosely connected to each sector of the upper cloth so that a plurality of vents are formed between the upper periphery of the lower cloth and a periphery of the upper cloth for venting wind therethrough.

6 Claims, 11 Drawing Sheets

UMBRELLA WITH VENTS ON THE UMBRELLA CLOTH FOR VENTING WIND

FIELD OF THE INVENTION

The present invention relates to an umbrella with vents on the umbrella cloth for venting wind, wherein by changing the shape of the umbrella cloth and adding a portion formed by a plurality of suspending cambered-elements, the wind within the umbrella can vent out rapidly and thus the wind pressure within the umbrella is released.

BACKGROUND OF THE INVENTION

The umbrella is a tool for shielding sunlight or raindrops. In general, an umbrella mainly comprises an umbrella frame and umbrella cloths for shielding sunlight and rain. The umbrella frame has a shaft and a plurality of main ribs and a plurality of supporting ribs. The umbrella cloth covers the umbrella frame so that as the umbrella is expanded, it can be used to shield raindrops or sunlight. After the umbrella is folded, it can be carried and stored conveniently.

As described hereinabove, the umbrella cloth is formed by a single layer of opaque cloth. In general, the structure of the umbrella cloth is dense for achieving the object of shielding sunlight and rain. Therefore, it is not preferred in air ventilation. Therefore, as the user walks with holding an umbrella in sunlight or rains, since air under the umbrella cloth can not be ventilated effectively, and further since a high temperature will be induced from the radiation of sunlight so that the space in the umbrella will be dull and thus, the user will feel uneasy. Furthermore, in typhoon, the wind pressure within the umbrella can not be released effectively and thus it is often the umbrella will turn upside down.

In order to increment the effect of ventilation, the prior art umbrella provides to structures. One is illustrated in FIG. 9, wherein the umbrella cloth 3 is formed by a lower cloth 30 and an upper cloth 31. In order to match the expansion of the main ribs 41, a plurality of openings 301 are formed between the lower cloth 30 and the main ribs 41. The upper cloth 31 is slightly smaller than the lower cloth. When the umbrella is assembled, the upper cloth 31 covers concentrically on the lower cloth 30 and then they are firmly secured to each main rib 41 of the umbrella frame 40. The plurality of openings 301 of the lower cloth 30 is shielded by the upper cloth 31. By this compound type umbrella cloth, when the umbrella is expanded, air may flow into gaps between the periphery 311 of the upper cloth 31 and the lower cloth 30. Then, the air flows to the space of the umbrella from the openings 301 in the upper cloth 30 so as to increase the flowing of the air under the umbrella or to prevent the umbrella from turning upside down as a large wind applies thereon.

Another structure of the umbrella is illustrated in FIG. 10, in that the umbrella 5 has a lower cloth 50 and an upper cloth 51. The lower cloth 50 is formed to be matched to the configuration of a complete expanding main ribs. The center of the lower cloth 50 is installed with a round web 501. As the umbrella is expanded for use, air flows into the gap between the periphery 511 of the upper cloth 51 and the web cloth 501 of the lower cloth 50 so as to increase the air convection in the umbrella, or the air may flow in the reverse direction so as to release the air pressure in the umbrella.

However, there are many defects in the aforesaid two compound umbrella cloth structure so that the use and manufacturing of the umbrella can not achieve an optimum effect. The reasons will be described in the following:

1. The effects of air convection and venting of wind pressure are not good: in the aforesaid two structures, the upper and lower umbrella cloths are concentrically overlapped on the umbrella ribs. When the umbrella is expanded, the upper and lower umbrella cloths are expanded by the main ribs. The outer periphery of the upper cloth almost adhered to the surface of the lower cloth so that the gap between the upper cloth and the lower cloth is too small, and thus air can not flow into the space in the umbrella successfully, or the wind pressure in the umbrella can not be smoothly released out. As a result, the effects of air convection and venting of wind pressure is not preferred.
2. Too much material is necessary for the umbrella cloths: in the aforesaid to prior art compound umbrella cloth, the upper cloth and lower cloth have a larger area so that overlapping area between the upper cloth and lower cloth are too large to be suitable. Especially, the outer periphery of the upper cloth shown in FIG. 9 is expanded by expensive elastic strips and then is fixed to the periphery of the lower cloth so that the cost for the material of the umbrella cloth is high.
3. The process for manufacturing the umbrella is complex: in the aforesaid prior art compound type structure, other than using umbrella cloth with a larger area, the lower cloth is formed with a plurality of openings or is connected to web cloth for air convection or venting of wind pressure. Therefore, the process for manufacturing the lower cloth is complex.

With reference to FIGS. 11 and 12, the U.S. Pat. No. 6,155,278 discloses a further prior art umbrella. The umbrellas can be used to improve the defects in the aforesaid two prior art umbrellas. In this prior art, the inner periphery of the lower cloth 21 has two sides which are formed with extension portions 212 on the main ribs 11. After it is stitched with the main ribs, a triangular overlapping portion 214 is formed, which is formed with a wind outlet 202 between the lower edge 201 of the upper cloth 20 and the upper edge 211 of the lower cloth 21 (see FIG. 12). Since the wind outlet 202 is confined to the tension force at two end points as the extension portion 212 is firmly stitched to the main ribs 11. Therefore, a large wind outlet 202 can not be achieved. Furthermore, an angle of almost 90 degrees is formed between the extension portion 212 and the upper edge 211 of each unit cloth of the lower cloth 21, it is very difficult in stitching the umbrella cloth. The stitching speed will be reduced greatly so that the manufacturing cost is high. Moreover, each unit cloth in the lower edge 201 of the upper cloth 20 is stitched to its respective unit cloth of the lower cloth 21 in a tension condition. Therefore, the wind outlet 202 is narrow and thus, the effect of venting wind pressure is very slight.

SUMMARY OF THE INVENTION

Accordingly, the primary object of the present invention is to provide an umbrella with vents on the umbrella cloth for venting wind pressure and increasing the convection of air under the umbrella cloth so that the manufacturing process is simplified and the cost is down.

To achieve above objects, the present invention provides an umbrella with vents on the umbrella cloth for venting wind. The umbrella comprises an umbrella frame and an umbrella cloth. The umbrella cloth comprises an upper cloth and a lower cloth. The upper cloth occupies most space of a surface of the umbrella; and the lower cloth is installed at a lower periphery. A lower periphery of the upper cloth covers upon the upper periphery of the lower cloth. An upper periphery of each unit of the lower cloth is a non-linear cambered portion. A suspending element is combined to the cambered upper portion of the lower cloth so as to be formed as a continuous multiple-lobe element having a plurality of cambered-recess portions at the upper periphery of the lower cloth. Therefore, an upper periphery of each unit of the lower cloth is loosely connected to each respective unit of upper cloth so that a plurality of vents are formed between the upper periphery of the lower cloth and the lower periphery of the upper cloth. As a result, the convection of air under the umbrella cloth is increased and the wind pressure is released.

The various objects and advantages of the present invention will be more readily understood from the following detailed description when read in conjunction with the appended drawing.

DETAILED DESCRIPTION OF THE PREFERRED EMBODIMENTS

Figure 1:
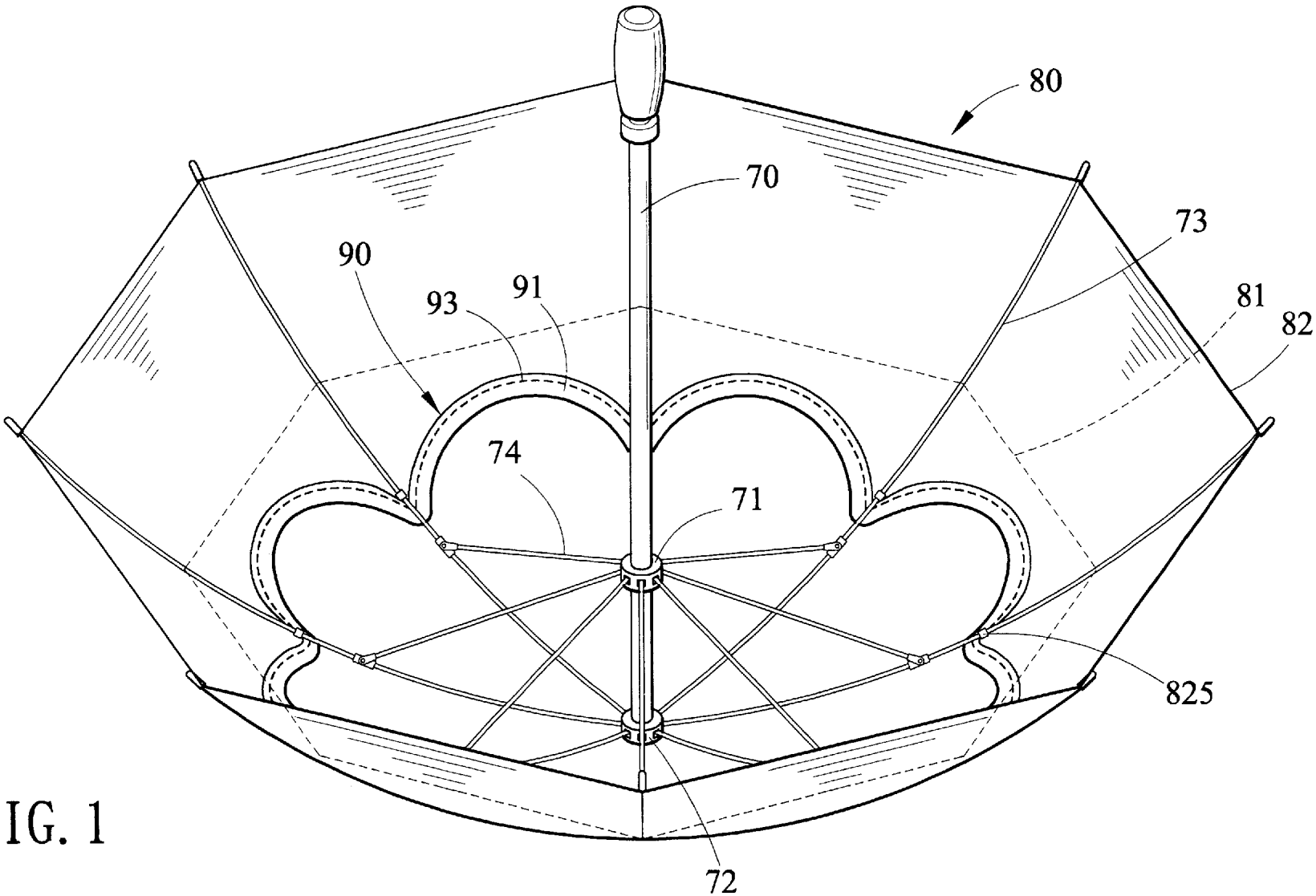
FIG. 1 is a schematic perspective view of a preferred embodiment of the present invention.
Figure 2:
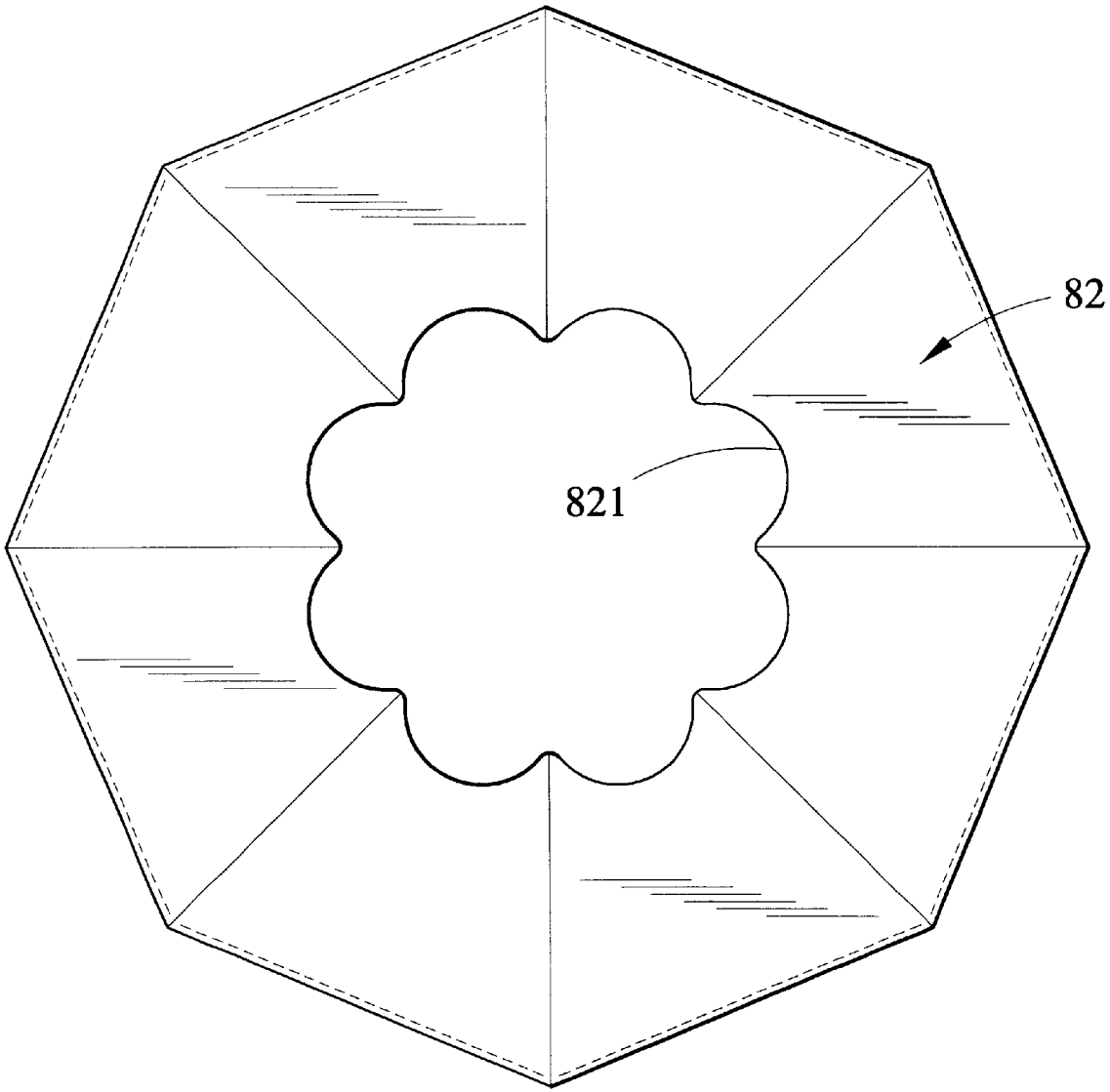
FIG. 2 is a plane schematic view of an embodiment of the lower cloth in the present invention.
Figure 3:
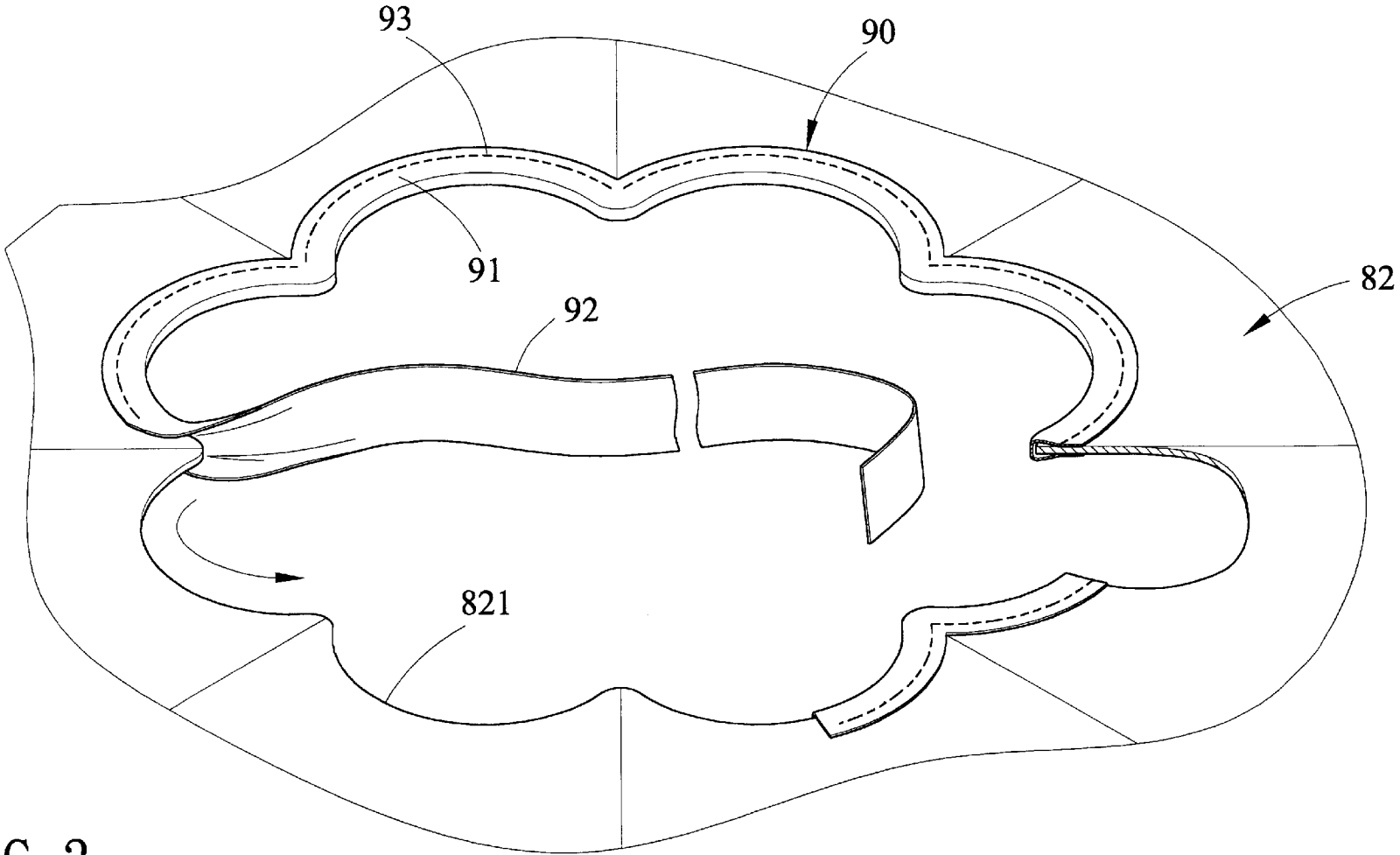
FIG. 3 is a schematic perspective view of the multiple-lobe element with a suspending cambered-recess element of the present invention.
Figure 4:
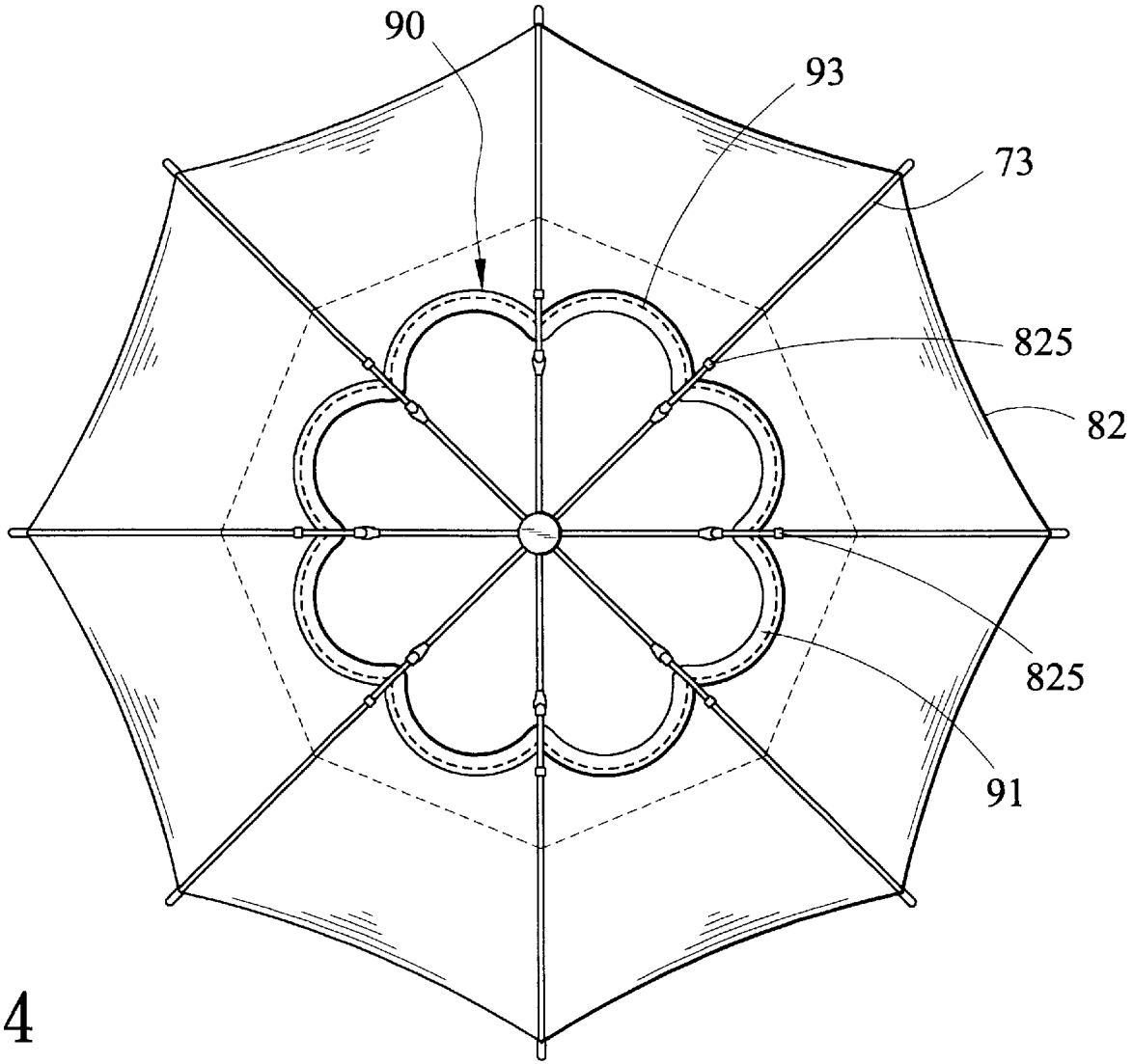
FIG. 4 is a plane view showing the connection of the lower cloth and the multiple-lobe element to the umbrella frame according to the present invention.

Referring to FIGS. 1 to 4, 8A and 8B, a preferred embodiment of the umbrella structure of the present invention is illustrated. The umbrella according to the present invention includes a shaft 70, a running ring 71, an upper ring 72, main ribs 73, supporting ribs 74, and others so as to be formed with an umbrella frame which can be expanded and folded. An umbrella cloth 80 includes an upper cloth 81 having a plurality of sectors and a lower cloth 82 having a plurality of sectors, equal in number to the sectors of the lower cloth. As shown in the figure, the upper cloth 81 is installed above the umbrella frame and covers most of the umbrella with an area occupied 60~70% of the whole umbrella. The lower cloth 82 is installed at an outer periphery of the umbrella. The upper periphery 821 is covered by the upper cloth 81. In order that a larger wind vent is formed between the lower periphery 811 of the upper cloth 81 and the upper periphery 821 of the lower cloth 82 (referring to FIG. 8B), in a preferred embodiment of the present invention, as shown in FIGS. 2 and 3, each sector of the upper periphery 821 is made as a curved peripheral portion 821. A suspending cambered-recess element 91 is formed thereon. For example, a piece of thick, weight, and strong elongate cloth 92 having an arcuate section is stitched on the upper curved peripheral portion 821 with stitches 93 and formed as a plurality of suspending cambered-recess element 91. The elements 91 are connected as petals of a blossom to be formed as a multiple-lobe element 90 with a plurality of cambered portions. Then, by use of stitches 93, it is stitched to the upper curved peripheral portion 821 of the lower cloth 82 to form as a whole as shown in FIG. 4.

Figure 6:
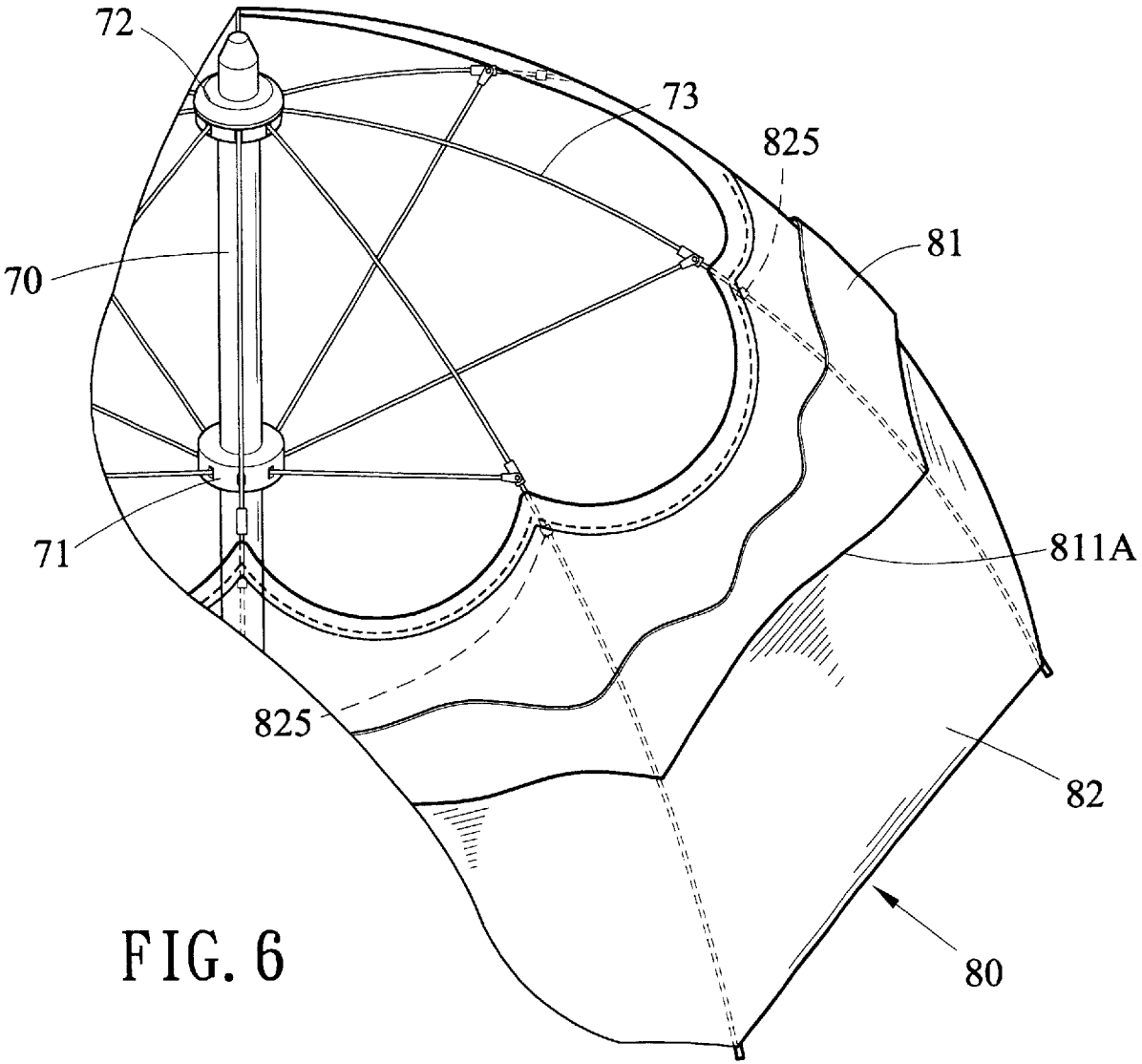
FIG. 6 is a partial schematic perspective view of another preferred embodiment of the present invention.
Figure 8B:
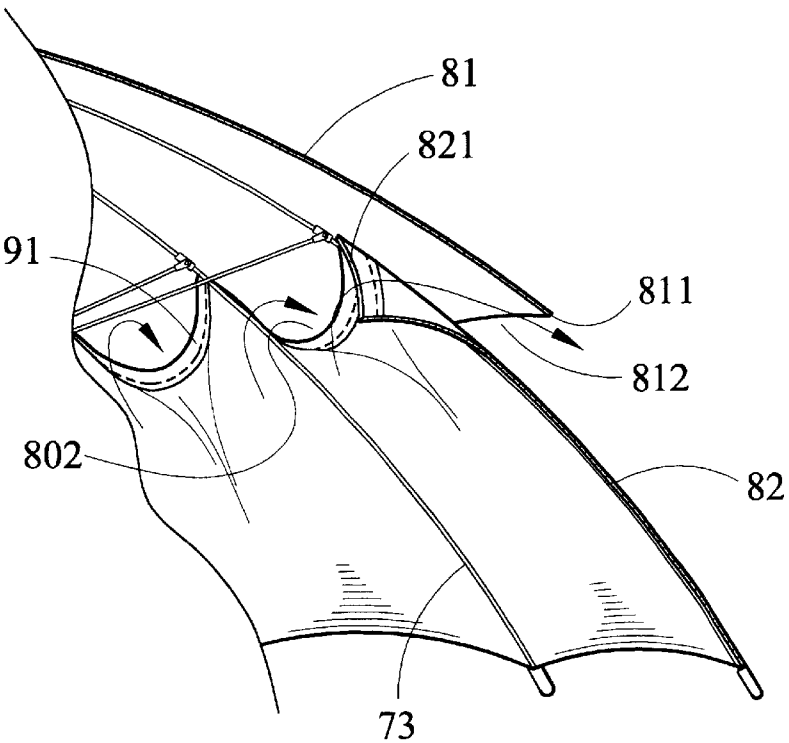
FIGS. 8A and 8B are lateral schematic cross sectional views showing the wind vents formed in the umbrella cloth in calm and windy weathers respectively.
Figure 8A:
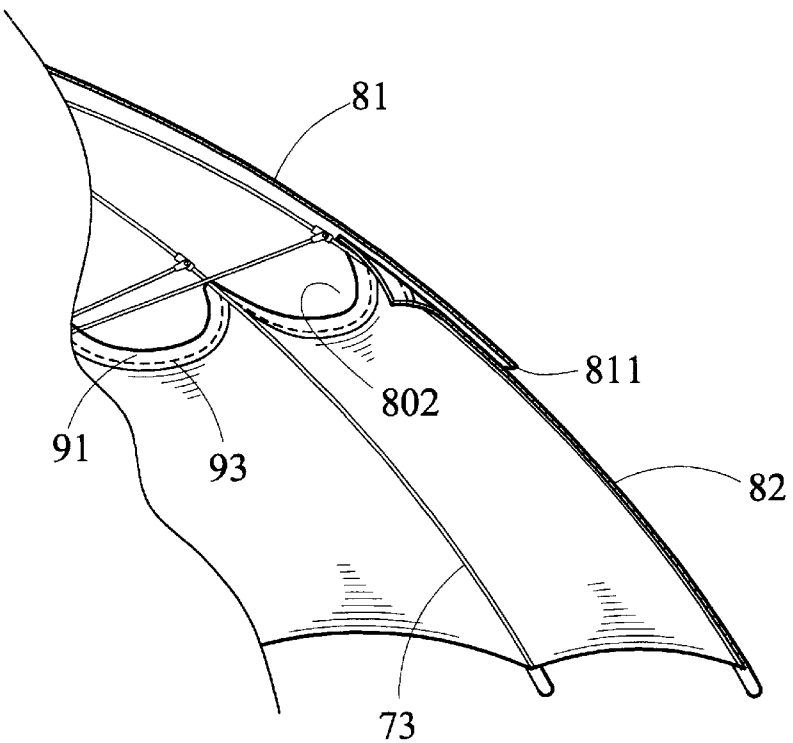
Figure 9:
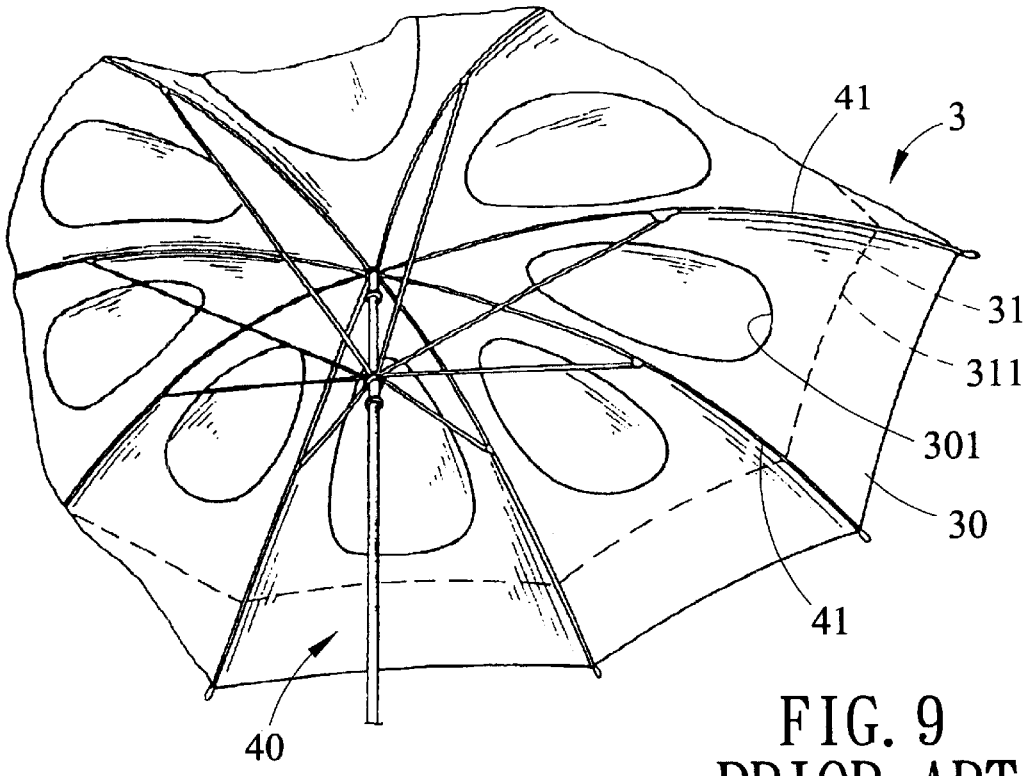
FIG. 9 PRIOR ART
FIG. 9 is a schematic perspective view of a first prior art umbrella.
Figure 10:
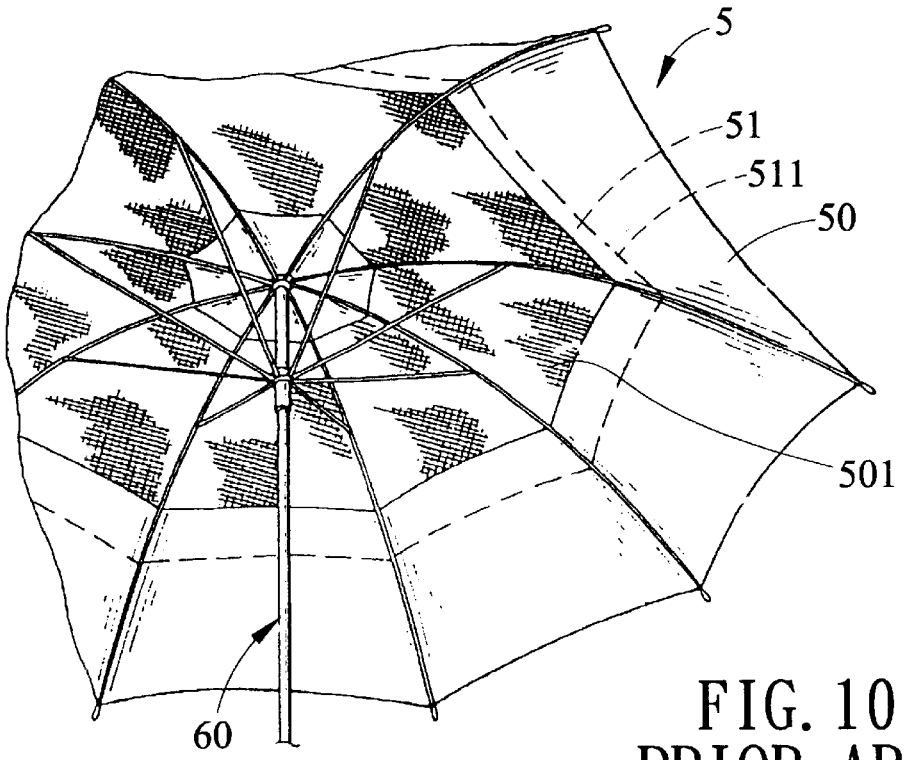
FIG. 10 PRIOR ART
FIG. 10 is a schematic perspective view of a second prior art umbrella.
Figure 11:
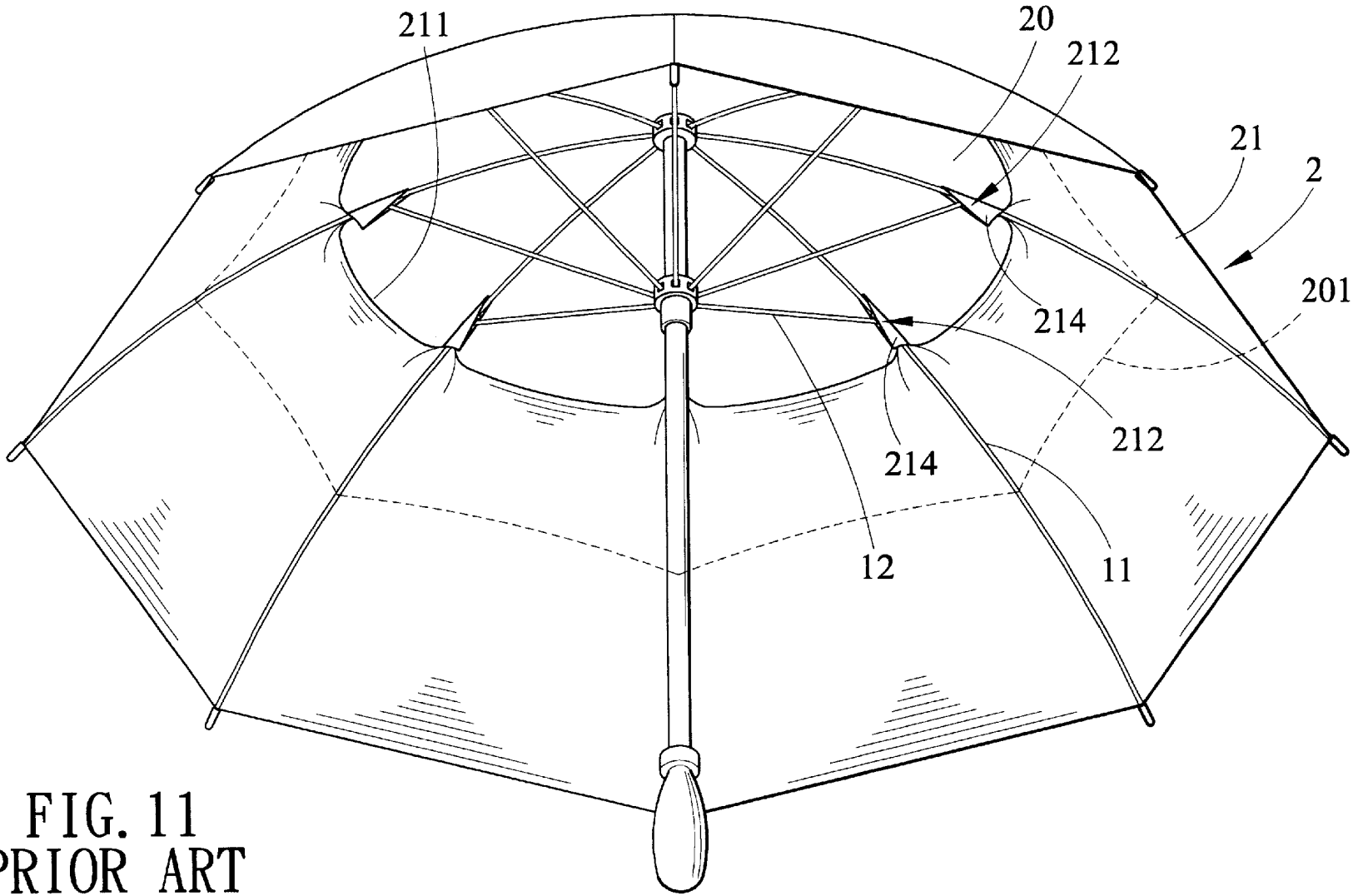
FIG. 11 PRIOR ART
FIG. 11 is a schematic perspective view of a third prior art umbrella.
Figure 12:
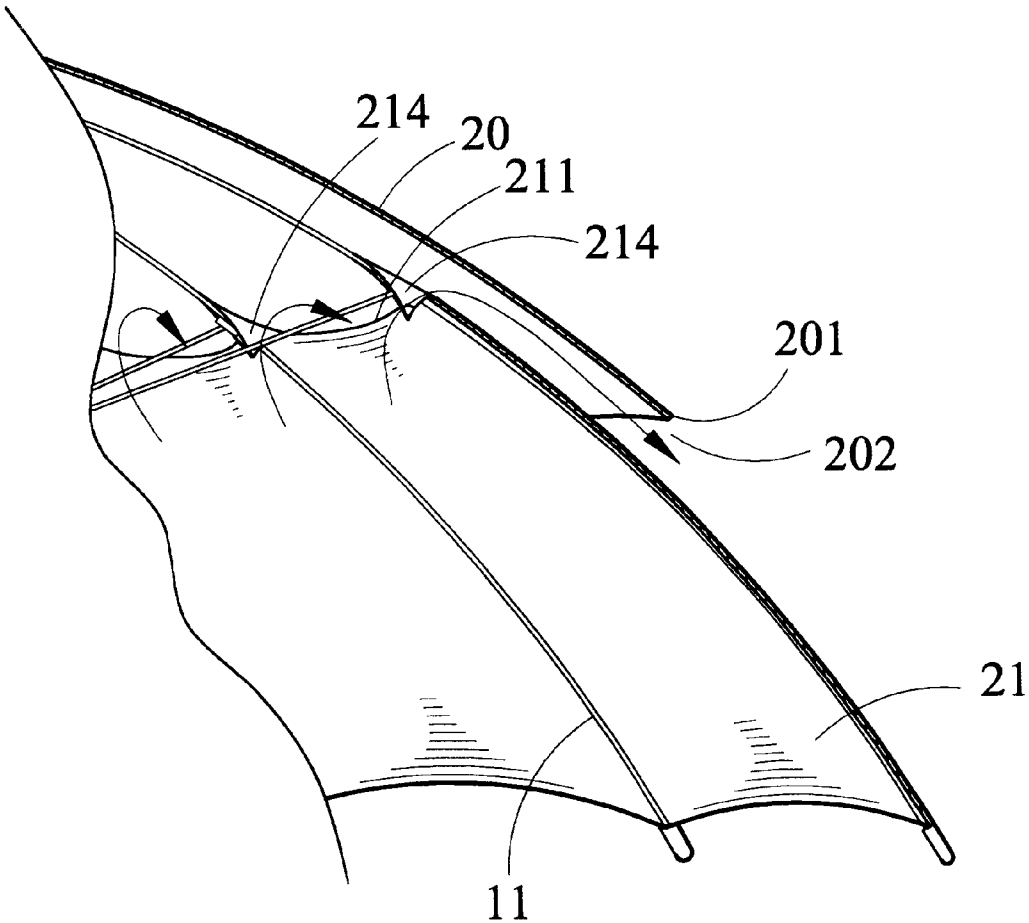
FIG. 12 PRIOR ART
FIG. 12 is a lateral schematic cross sectional view of FIG. 11 showing that the vents are opened in strong wind.

It is appreciated from FIGS. 4 and 6, each unit (petal) of the suspending cambered-recess element 91 in the multiple-lobe element 90 is not stitched to the main rib 73. Two points 825-825 at a lower portion of the cambered portion of the upper periphery of the lower cloth 82 are stitched to the main rib 73. The connection therebetween is loose and thus a suspending inner vent 802 (for example, that illustrated in FIG. 8A) is formed. Namely, in a normal condition, a plurality of suspending inner vents 802 with a sufficient size is formed between the suspending cambered-recess element 91, i.e., between the lower periphery 811 of the upper cloth 81 and the curved upper periphery 821 of the lower cloth 82. As shown in FIG. 8B, each sector of the curved peripheral portion 821 of the lower cloth 82 is expanded in the natural suspending direction by the elements 91, and moreover, the opening from the suspending of the elements 91 will not be affected by the stitching relation between the lower cloth 82 and the main rib 73. Thus the suspending inner vents 802 can be expanded to a maximum level so as to increase the effect of venting of wind. This is an important feature of the present invention.

Figure 5:
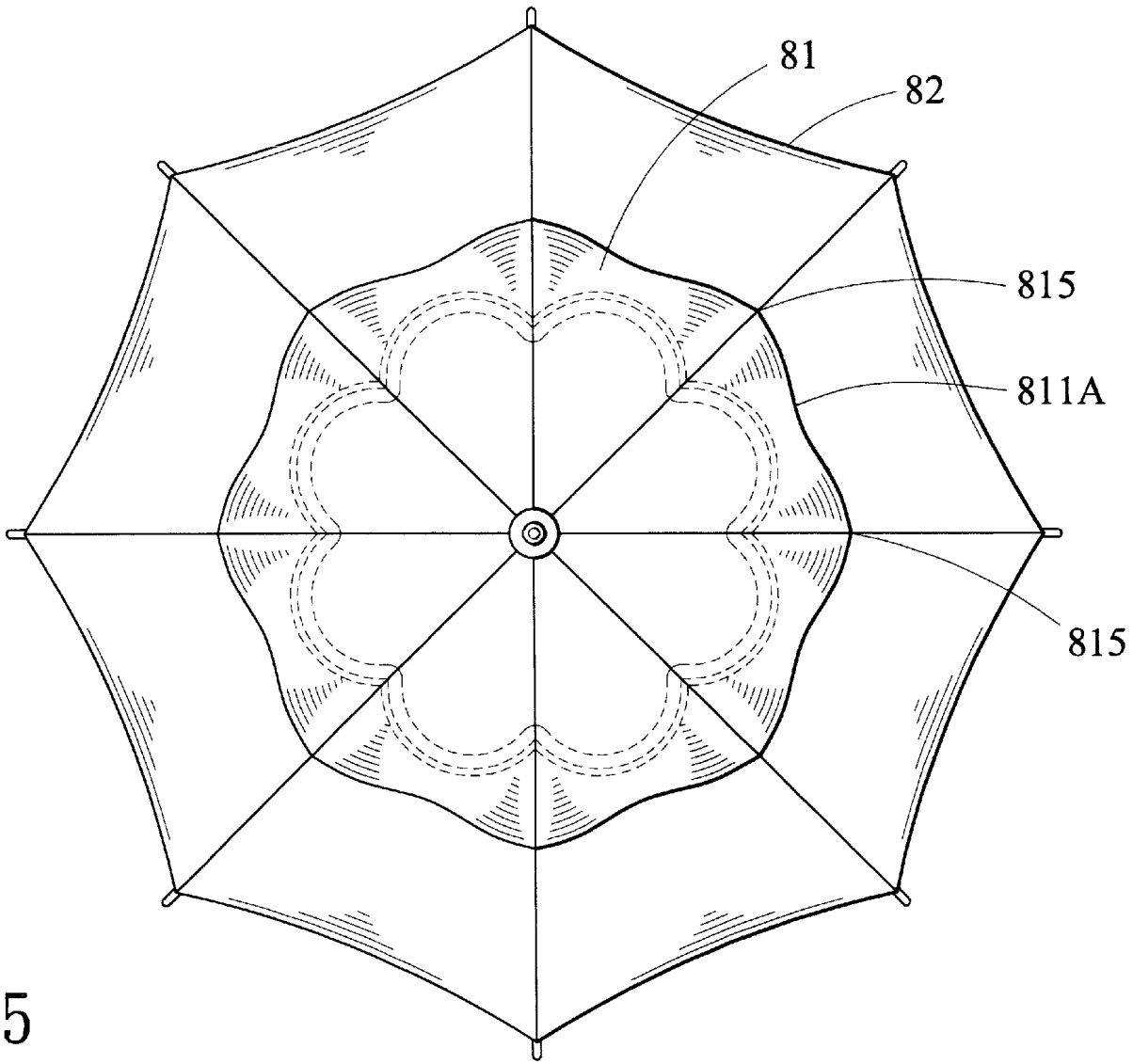
FIG. 5 is a plan view of the umbrella cloth of another preferred embodiment of the present invention.
Figure 7:
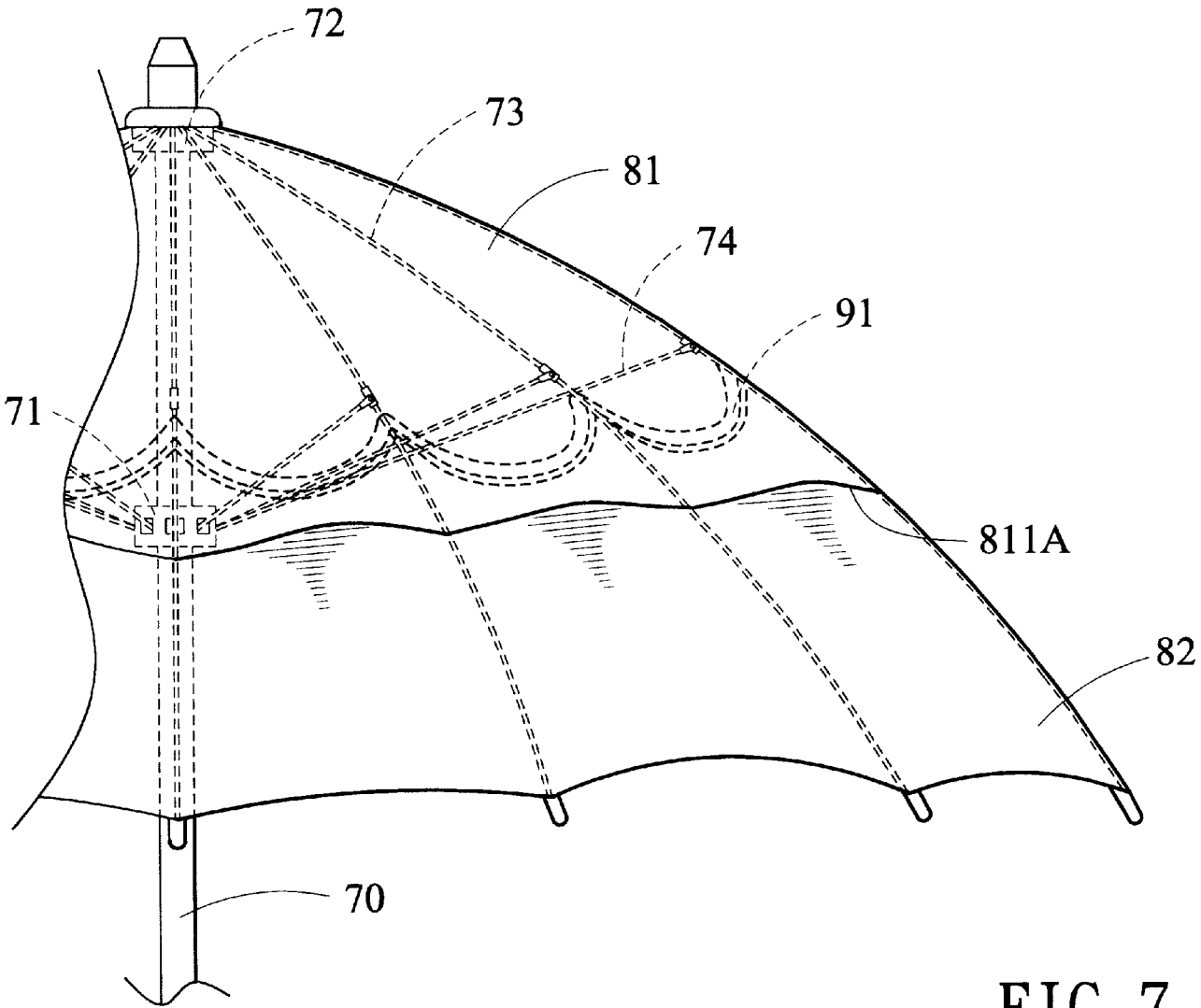
FIG. 7 is a partial schematic cross sectional view of another preferred embodiment of the present invention.

Another preferred embodiment of the present invention is illustrated in FIGS. 5 to 8B, the structure in this embodiment is substantially identical to that in the first embodiment, except that the two end points 815-815 for stitching points between each unit of the lower periphery 811 of the upper cloth 81 and the lower cloth 82 is fixed loosely so as to be formed as wave-shaped lower periphery 811A as illustrated in FIGS. 5 to 7. Therefore, as wind pressure of the umbrella is released, the outer vents 812 (see FIG. 8B) have a larger volume. Therefore, the volume of each outer vent 812 is self-adjustable in response to the wind pressure. This is another feature of the present invention.

It should be noted that the width and weight of the suspending cambered-recess elements 91 is adjustable according to the sizes of the inner vent 802 and outer vents 812 so as to have a preferred wind venting effect.

In the present invention, since a thick, weight, and strong of cloth is used to combine the lower cloth of each unit to the curved upper periphery as an integral body. As such larger inner vents and outer vents are formed between the lower periphery of the upper cloth and the upper periphery of the lower cloth. Hence, wind pressure can be released immediately. As a result, the umbrella is resistant to inversion from the wind. Furthermore, the air within the coverage of the umbrella may be transferred effectively so that the user may avoid the radiation of the strong sunlight. Moreover, the present invention has a simple structure and can be assembled easily with a lower cost.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An umbrella comprising:

a foldable frame including a main shaft, a fixed ring secured to a top portion of the main shaft, a running ring slidable along the main shaft, a plurality of main ribs pivotally connected to the fixed ring, and a plurality of supporting ribs pivotally interconnected the main ribs and the running ring; and an umbrella cloth including a lower cloth being stitched above the main ribs and having a plurality of sectors, each sector having a curved upper peripheral portion and an upper cloth having a plurality of sectors, equal in number to the sectors of the lower cloth, each sector of the upper cloth having a lower peripheral portion, the upper cloth being in covering relation to the curved upper periphery of the lower cloth;

wherein a suspending cambered-recess element is formed by coupling a piece of elongate cloth to the curved upper periphery in each sector of the lower cloth together, whereby a continuous multiple-lobe element is formed around entire the curved upper periphery of the lower cloth, and each two end points of the curved upper periphery in each sector of the lower cloth is further loosely connected to each corresponding sector of the upper cloth so that a plurality of inner and outer vents are formed between the curved upper periphery of the lower cloth and the lower periphery of the upper cloth for venting wind therethrough.

2. The umbrella as claimed in claim 1, wherein the piece of elongate cloth is formed of a strong, weight and thick cloth and has an arcuate section.

3. The umbrella as claimed in claim 1, wherein the continuous multiple-lobe element is formed by stitching the suspending cambered-recess elements around the entire curved upper peripheral portions of the lower cloth.

4. The umbrella as claimed in claim 1, wherein each two ends for stitching points between each sector of the lower peripheral portion of the upper cloth and an upper portion of the lower cloth is fixed loosely so as to be formed as a wave shape to thereby provide a large volume of the outer vent between the lower peripheral portion of the upper cloth and the lower cloth.

5. The umbrella as claimed in claim 1, wherein a volume of the outer vent is self-adjustable in response to the wind pressure.

6. The umbrella as claimed in claim 1, wherein a width and weight of the suspending cambered-recess elements are adjustable according to the sizes of the inner vent and outer vent so as to have a wind venting effect.

* * * * *